US006786171B1

(12) United States Patent
Elbers

(10) Patent No.: US 6,786,171 B1
(45) Date of Patent: Sep. 7, 2004

(54) BOAT COVER

(76) Inventor: Gary M. Elbers, 8626 Port Said St., Orlando, FL (US) 32817

( * ) Notice: Subject to any disclaimer, the term of this patent is extended or adjusted under 35 U.S.C. 154(b) by 0 days.

(21) Appl. No.: 10/719,036

(22) Filed: Nov. 24, 2003

(51) Int. Cl.[7] ..... B63B 17/02
(52) U.S. Cl. ..... 114/361; 135/90
(58) Field of Search ..... 114/361, 44; 135/87, 135/90; 212/330, 331; 405/3, 4; 414/560, 561

(56) References Cited

U.S. PATENT DOCUMENTS

| | | | | |
|---|---|---|---|---|
| 524,137 A | | 8/1894 | Enright | |
| 1,134,630 A | | 4/1915 | McGoldrick | |
| 2,529,948 A | | 11/1950 | Jones | |
| 2,708,346 A | | 5/1955 | Smith | |
| 4,019,212 A | | 4/1977 | Downer | |
| 5,027,739 A | | 7/1991 | Lackovic | |
| 5,058,946 A | | 10/1991 | Faber | |
| 5,086,799 A | * | 2/1992 | Lumbleau | 135/90 |
| 5,269,332 A | | 12/1993 | Osborne | |
| 5,281,077 A | | 1/1994 | Phillips | |
| 5,593,247 A | | 1/1997 | Endres et al. | |
| 5,709,501 A | | 1/1998 | Elbers | |
| 5,769,105 A | * | 6/1998 | Margol et al. | 135/90 |
| 5,769,568 A | | 6/1998 | Parkins et al. | |
| 5,947,639 A | * | 9/1999 | Bishop et al. | 405/3 |
| 6,102,059 A | * | 8/2000 | Miller | 135/87 |
| 6,174,106 B1 | | 1/2001 | Bishop et al. | |
| 6,457,904 B2 | | 10/2002 | Bishop et al. | |
| 6,688,252 B1 | * | 2/2004 | Caravella | 114/361 |

* cited by examiner

*Primary Examiner*—S. Joseph Morano
*Assistant Examiner*—Lars A Olson
(74) *Attorney, Agent, or Firm*—William M. Hobby, III

(57) ABSTRACT

A boat cover includes a framework shaped to be attached to a plurality of pilings of a boat hoist beneath or above the boat hoist. A fabric boat cover has the framework and the sides thereof are lowered when a boat is hoisted thereunder. A boat cover raising and lowering mechanism raises and lowers the cover sides and has a rotatable shaft operatively rotated by a motor connected thereto and is located beneath the boat cover.

12 Claims, 3 Drawing Sheets

BOAT COVER

BACKGROUND OF THE INVENTION

The present invention relates to a boat cover and especially to a boat cover which covers a boat when the boat is hoisted with a boat hoist.

In the past, it has been common to provide boat decks and boat houses for the maintaining of boats when the boats are not being used. Typically, such boat docks have an open framework having a roof mounted thereover and may be provided with sidewalls so that the boat can be driven directly into the boat house. It is common to provide a boat hoist or winching mechanism for attaching ropes or cables to the boat and then elevating the boat out of the water supported on the framework beneath the roof. It is also old to provide canvas or flexible covers for a boat so that the cover can be drawn over the top of the boat and held therearound with draw ropes at the peripheral edge thereof for retaining the lower edge portion of the canvas in abutting relationship to the sides of the boat.

Boat covers typically cover boats when they are out of water, such as on trailers, and even when they are in the water and moored for extended periods of time to protect the tops of the boats. Some boat owners also cover their boats when they are not going to be used for a period of time even though they are kept within the boat house and elevated above the water under the roof of the boat house. This is to prevent an accumulation of dirt, moisture, and the like when the boat is not going to be used for any extended period of time. However, this becomes a difficult operation to attach and remove the boat cover since the boat is being suspended from ropes or cables during the time the boat is being covered. The absence of a separate cover over the boat will allow dirt, insects, and the like to accumulate on the interior of the boat and sun damage to the outside and inside of the boat. The present invention is directed towards a boat cover which automatically covers the boat whenever the boat is hoisted therebeneath and automatically raises the boat cover when the boat hoist lowers the boat into the water.

In the Downer, U.S. Pat. No. 4,019,212, a boat cover apparatus is provided which provides a manual lift system mounted to a frame for lifting a boat above the water and includes cables for attaching and lifting the boat. A boat cover is attached to a specially designed frame shaped to fit over the sides of the boat and is supported from flexible cords or cables and has a hand wench so the cover can be lowered or raised manually after the boat has been lifted. Thus, the boat is manually lifted with a manual boat hoist and then, in a separate operation, a frame having a cover attached is lowered with a separate hand wench down over the top of the boat.

In the Osborne U.S. Pat. No. 5,269,332, a retractable protective cover for boats, cars, and the like is operated with a manual wench pulling a cover through an elongated tube where it is retracted and extended for covering a car. The Faber U.S. Pat. No. 5,058,946, is a hinged trailer boat cover which has a rigid boat cover mounted to a trailer for covering the boat when towing the boat on the trailer or for storage on the trailer. The Lackovic U.S. Pat. No. 5,027,739, is a demountable cover for a boat hatchway which swings a cover on a supporting arm. The Enright U.S. Pat. No. 524,137, is a portable awning for vessels supported from a boom arm. The McGoldrick U.S. Pat. No. 1,134,630, is a life boat and launching mechanism therefor.

A boat hoist and cover assembly apparatus and method are taught in my prior U.S. Pat. No. 5,709,501 for a Boat Hoist Cover Assembly. This prior patent uses a boat hoist having a rotatable lift shaft having a plurality of ropes or cables coiled therearound in one direction of rotation and extending therefrom for removably coupling to a boat for lifting a boat by the rotation of the hoist lift shaft. A boat cover has a plurality of cables or ropes attached thereto and coiled around the boat hoist lift shaft in a second direction of rotation from that of the boat hoist ropes to thereby lower the boat cover when hoisting the boat and to raise the boat cover when lowering the boat so that a boat cover covers a boat whenever the boat is hoisted by the boat hoist. The method uses the selected boat hoist and cover assembly and rotates the boat hoist shaft to lift an attached boat while lowering the boat cover onto the boat.

In contrast, the present invention provides a boat cover that lowers onto the boat when lifting the boat with a hoist and raises the boat cover when lowering the boat to avoid the complexities of covering a boat in a boat house when storing the boat.

SUMMARY OF THE INVENTION

A boat cover for a boat hoist includes a framework shaped to be attached to a plurality of pilings of a boat hoist above or beneath the boat hoist. A fabric boat cover has a top portion attached over the framework and a side portion extending over the sides of the framework. A plurality of cover frame members are attached to the fabric boat cover side portion in a spaced relationship to each other. A boat cover raising and lowering mechanism raises and lowers the cover side portion and has a rotatable shaft operatively rotated by a motor connected thereto. The shaft is attached to the framework beneath the fabric boat cover top portion and has a plurality of winding cords connecting at one end to the shaft for rotation therearound upon rotation of the shaft. Each winding cord is connected at the other end thereof to the bottom one of a plurality of cover frame members attached to the fabric cover side portion. At least one of the winding cords connects to a plurality of lifting cords which are in turn connected to the bottom cover frame member so that rotating the shaft in one direction will wind the plurality of winding cords thereon to raise the boat cover side portion from around a boat and rotating the shaft in the other direction will unwind the winding cords to lower the boat cover side portion along the sides of a boat hoisted therein. A plurality of winding cords includes a first winding cord wrapped around the shaft in one direction and a second winding cord wrapped around the shaft in a second direction whereby rotation of the shaft will wind or unwind the first and second winding cords simultaneously. The boat cover framework includes a perimeter frame portion and at least one cross frame member having the shaft attached thereto between a pair of journals. A plurality of pulleys direct the winding cord and lifting cords for connecting to the bottom cover frame member. The frame can be made out of metal or polymer pipe members while the fabric cover can be a generally waterproof polymer fabric.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
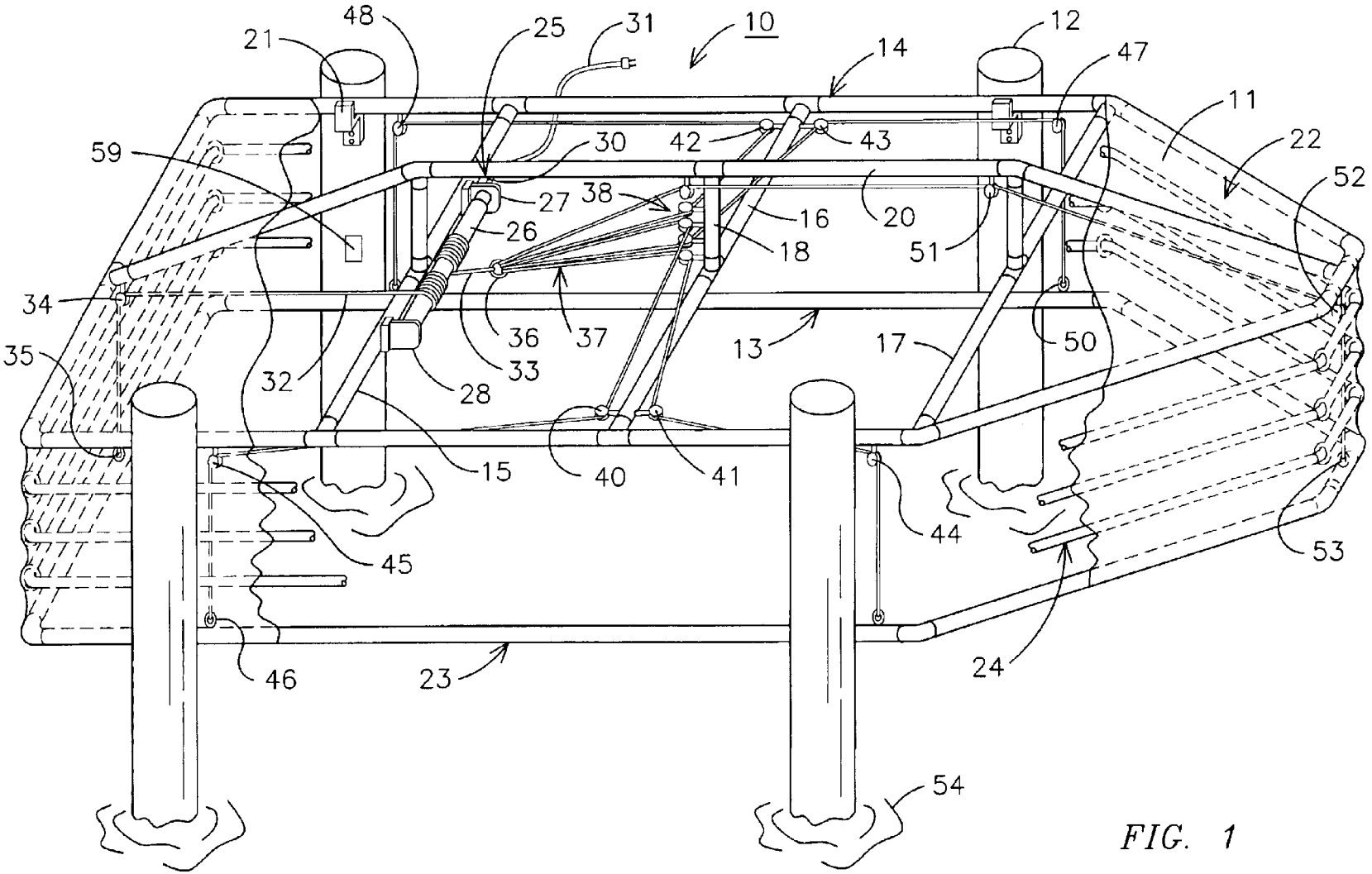
FIG. 1 is a cut away perspective of a boat cover for a boat hoist in accordance with the present invention having the cover partially lowered.
Figure 2:
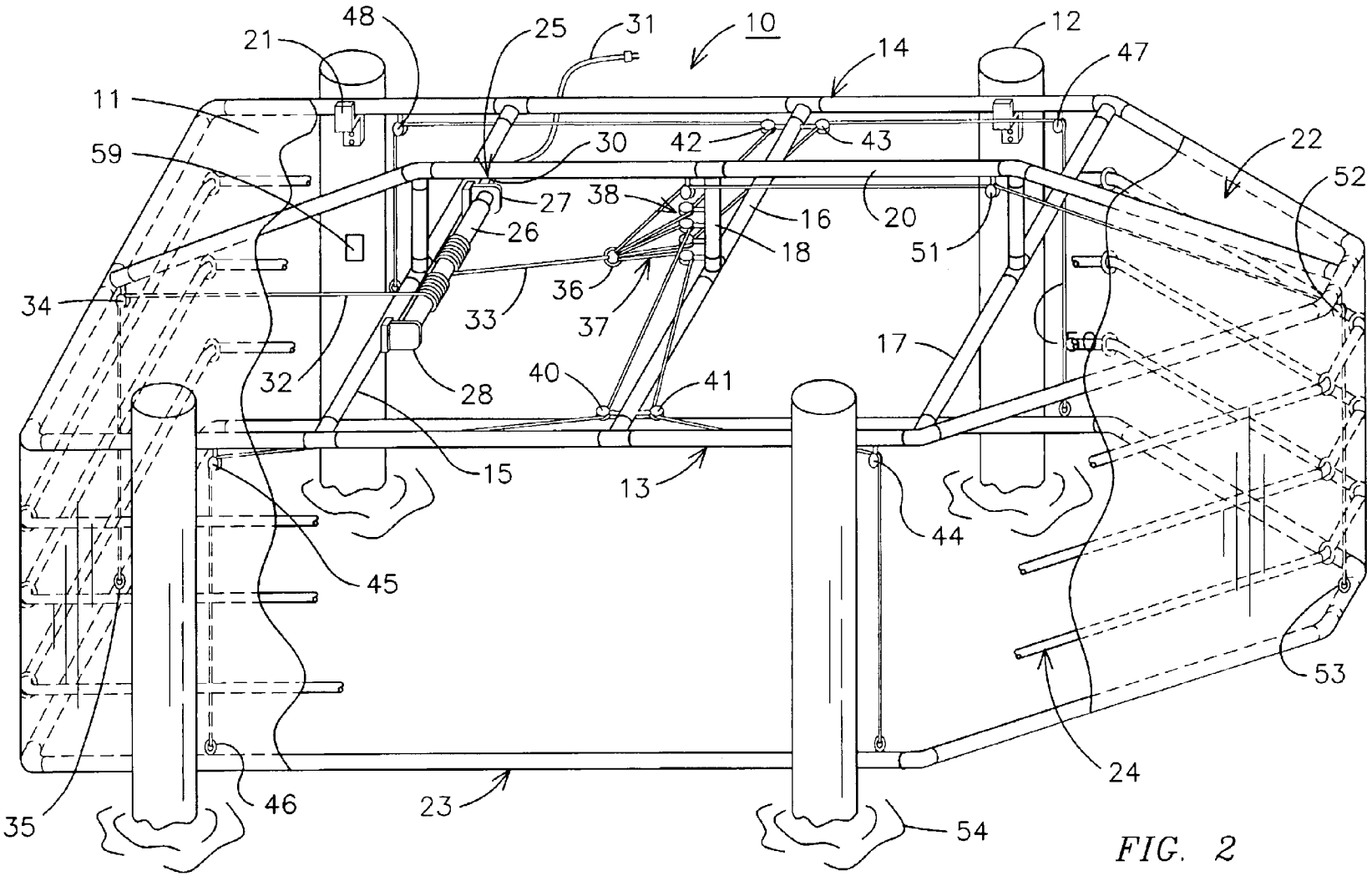
FIG. 2 is a perspective view of the boat cover for a boat hoist in accordance with claim 1 having the cover lowered.
Figure 3:
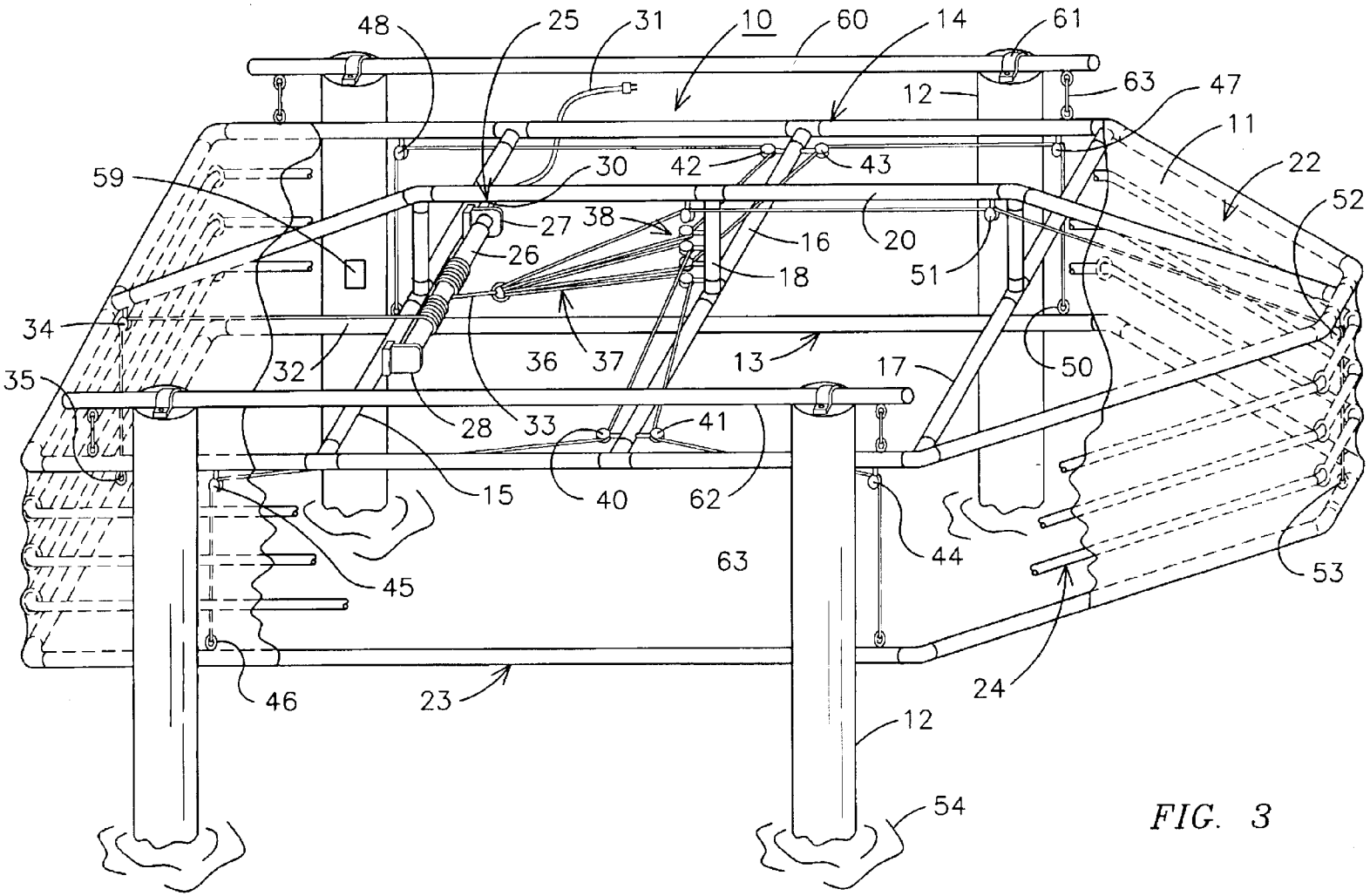
FIG. 3 is a cutaway perspective of a boat cover of FIG. 1 having alternative attachments for the pilings.

Referring to the drawings of FIGS. 1 through 3, a boat cover 10 is illustrated having a portion of the covering fabric 11 cut away to show the operating mechanism of the boat cover. The boat cover would typically be mounted beneath a boat hoist or in a boat dock and can have separate pilings 12 for mounting the boat cover 10 which can also be mounted to the existing pilings for supporting the boat hoist or dock. Framework 13 has a perimeter frame 14 which can be made of metal or polymer pipe and has a plurality of cross frame members 15, 16, and 17, each of which supports a center vertically extending support 18 attached to a center frame member 20. A plurality of frame attaching brackets 21 are each attached to one of the pilings 12 and is shaped to cradle the perimeter frame 14 therein on at least four points, as illustrated in FIGS. 1 and 2. Fabric 11 extends over the top of the framework 13 and around the sides of the perimeter frame 14. The side extending fabric 22 has attached to the bottom thereof a weighted cover frame member 23 which may also be made of a plastic or metal pipe. A plurality of additional cover frame members 24 allow the side cover 22 to be raised or lowered in an orderly manner while stiffening the side cover. The cross member 15 has a boat cover raising and lowering mechanism 25 which acts like a wench having a rotating shaft 26 supporting between a pair of journals 27 and 28, each of which are attached to the cross frame member 15. An electric motor 30, having an electric cord 31 extending therefrom, is attached to the journal 27 and is operatively attached to the shaft 26. The rotating shaft 26 has a winding cord 32 to which winds partially therearound in one direction and extends from the top of the shaft 26. A winding cord 33 is also coiled around the shaft 26 but coiled in the opposite direction from cord 32. It extends from the bottom of the shaft 26 such that when the electric motor 30 rotates the shaft 26 in one direction, both coiled cords 32 and 33 will unwind simultaneously and when the motor rotates the shaft 26 in the opposite direction, both will be wound back onto the shaft 26. The winding cord 32 extends around a pulley 34 and is attached to an eyelet 35 attached to the boat cover frame 23 so that when the shaft 26 is rotated in either direction, it will raise or lower the cord 32 to raise or lower one end of the frame 23. The winding cord 33 is attached to a ring 36 which has a plurality of lifting cords 37 attached thereto. Four of the lifting cords 37 are wrapped around four pulleys 38 which in turn directs two of the cover lifting cords 37 around a pair of pulleys 40 and 41 on one side thereof and around a pair of pulleys 42 and 43 on the opposite side thereof. The pulleys 40 and 41 direct the cord 37 around a pair of pulleys 44 and 45 which in turn direct their respective cords to an eye 46 attached to the cover frame member 23. The cords 37 that extend through the pulleys 42 and 43 similarly pass through pulleys 47 and 48 which in turn are directed to a pair of eyelets 50 attached to the bottom cover frame member 23. One final cord 37 extends over a pulley 51 and over a pulley 52 to direct a cord to an eyelet 53 attached to the perimeter frame 23.

Thus, when the winding cord 33 is wrapped on the shaft 26, it simultaneously pulls all of the cords 37 which are then directed through a series of pulleys to the perimeter frame 23 which are then simultaneously lifted by the pulling of the one cord 33. Inasmuch as the winding cords 32 and 33 are being wrapped and unwrapped simultaneously from the shaft 26, the boat cover frame member 23 has been raised or lowered simultaneously to raise or lower the side of the boat cover 22. When a boat is pulled between the pilings 12 and the water 54, a hoist located above the boat cover 10 can have boat lifting cables extending through the top of the cover fabric 11 to attach to the boat for lifting the boat up into the cover and the cover sides 22 lowered around the boat so that the boat is not only lifted from the water 54 but is covered over the top and all sides by the cover 11 and side cover 22. The side cover 22 can be raised or lowered by switching the electric motor 30 in a forward or reverse direction as desired and can be actuated by a micro switch 59 any time the boat is raised by the boat hoist. A regular manually operated switch may also be used as well as a wireless remote as desired.

FIG. 3 illustrates the boat cover of FIGS. 1 and 2 in which the brackets 21 of FIGS. 1 and 2 have been replaced by supporting rods 60 attached with brackets 61 to the top of the pilings 12. The support rods 60 and 62 each having a cable 63 extending from each end thereof and attached to the perimeter frame 14 of the frame 13 of the boat cover 10. The boat cover then operates in the same manner. The boat covers of FIGS. 1 through 3 can be mounted to existing pilings of a hoist or boat dock or can be mounted to separate pilings specifically put in for the boat cover 10.

It should be clear at this point that the present invention illustrates a boat cover for use with a boat hoist or dock which can be automatically actuated to raise and lower the sides of the boat cover and in which the boat cover operating mechanism is positioned below the top of the boat cover where it is protected from the elements. However, the present invention should not be construed as limited to the forms shown which are to be considered illustrative rather than restrictive.

I claim:

1. A boat cover for a boat hoist comprising:

a framework shaped to be attached to a plurality of pilings of a boat hoist;

a fabric boat cover having a top portion attached over said framework and a side portion extending over the sides of said framework;

a plurality of cover frame members attached to said fabric boat cover side portion in spaced relationship to each other; and a boat cover raising and lowering mechanism for raising and lowering said cover side portion, said boat cover raising and lowering portion having a rotatable shaft operatively rotated by a motor connected thereto, said shaft being attached to said framework beneath said fabric boat cover top portion, and having a plurality of winding cords connected at one end to said shaft for rotation therearound upon rotation of said shaft, each said winding cord being connected to the other end thereof to one of said plurality of cover frame members attached to said frame cover side portion whereby rotating said shaft in one direction will wind said plurality of winding cords thereon to raise said boat cover side portion and rotating said shaft in the other direction will unwind said winding cords thereon to lower said cover side portion.

2. A boat cover for a boat hoist in accordance with claim 1 in which said plurality of winding cords includes a first winding cord wrapped around said shaft in one direction and a second said winding cord wraps around said shaft in the other direction whereby rotation of said shaft will wind or unwind said first and second winding cords simultaneously.

3. A boat cover for a boat hoist in accordance with claim 2 in which said framework includes a perimeter frame portion and at least one cross frame member.

4. A boat cover for a boat hoist in accordance with claim 3 including a plurality of pulleys attached to said framework.

5. A boat cover for a boat hoist in accordance with claim 4 including a plurality of lifting cords attached to one of said winding cords, each of said plurality of lifting cords passing around one said pulley.

6. A boat cover for a boat hoist in accordance with claim 5 in which said motor is an electric motor.

7. A boat cover for a boat hoist in accordance with claim 6 in which said framework has a plurality of connected plastic pipe frame members.

8. A boat cover for a boat hoist in accordance with claim 7 in which each said lifting cord is connected to the bottom most of said plurality of cover frame members.

9. A boat cover for a boat hoist in accordance with claim 8 including a plurality of framework brackets, each said framework bracket being attached to one of a plurality of hoist pilings for attaching said framework perimeter frame thereto.

10. A boat cover for a boat hoist in accordance with claim 4 in which said fabric cover is a generally waterproof polymer fabric.

11. A boat cover for a boat hoist in accordance with claim 10 in which said shaft is a pipe extending between and rotatably supported between two journals, said pipe having said motor attached to one end for rotation of said pipe on said journals.

12. A boat cover for a boat hoist in accordance with claim 11 including a plurality of eyes attached to said cover frame bottom most cover frame member and having one said lifting cord attached thereto.

* * * * *